United States Patent [19]

Borst et al.

[11] Patent Number: 4,865,002

[45] Date of Patent: Sep. 12, 1989

[54] FUEL SUPPLY SYSTEM FOR INTERNAL COMBUSTION ENGINE

[75] Inventors: Gaylord M. Borst, Highland Park; Jeffrey A. Olson, Mundelein, both of Ill.

[73] Assignee: Outboard Marine Corporation, Waukegan, Ill.

[21] Appl. No.: 159,661

[22] Filed: Feb. 24, 1988

[51] Int. Cl.[4] ..... F02M 67/04

[52] U.S. Cl. ..... 123/532; 123/316; 123/73 C

[58] Field of Search ..... 123/26, 316, 531, 532, 123/533, 73 C

[56] References Cited

U.S. PATENT DOCUMENTS

| | | | |
|---|---|---|---|
| 1,411,034 | 3/1922 | Kemp | 123/532 X |
| 1,674,014 | 6/1928 | Lawrence | 123/459 |
| 2,111,560 | 3/1938 | Fox | 137/505.39 |
| 2,192,630 | 3/1940 | Beam | 137/505.39 |
| 2,329,363 | 9/1943 | Thomas | 137/505.39 |
| 2,707,051 | 4/1955 | Mailhot et al. | 137/505.39 |
| 2,710,600 | 6/1955 | Nallinger | 123/532 X |
| 2,819,728 | 1/1958 | Gage et al. | 137/505.39 |
| 3,106,226 | 10/1963 | Machen | 137/517 |
| 3,116,752 | 1/1964 | Duncan | 137/384.6 |
| 3,205,876 | 9/1965 | Stuhr | 123/532 X |
| 3,682,146 | 8/1972 | Mozokhin et al. | 123/275 |
| 3,785,355 | 1/1974 | Toepel | 123/568 |
| 3,919,986 | 11/1975 | Goto | 123/316 |
| 4,103,648 | 8/1978 | Jarry | 123/316 |
| 4,191,135 | 3/1980 | Nohira | 123/262 |
| 4,210,105 | 7/1980 | Nohira et al. | 123/277 |
| 4,223,645 | 9/1980 | Nohira et al. | 123/292 |
| 4,232,641 | 11/1980 | Curtil | 123/76 |
| 4,406,260 | 9/1983 | Burley | 123/258 |
| 4,413,652 | 11/1983 | Allewitz | 138/31 |

*Primary Examiner*—Willis R. Wolfe

*Attorney, Agent, or Firm*—Michael, Best & Friedrich

[57] ABSTRACT

Disclosed herein is an internal combustion engine comprising a cylinder, a piston reciprocal in the cylinder, an accumulation chamber, a supply conduit which includes a valve and which communicates between the cylinder and the accumulation chamber for supplying pressure gas from the cylinder to the accumulation chamber in response to piston reciprocation to thereby accumulate pressure gas in the accumulation chamber, a discharge conduit which includes a valve and which communicate between the accumulation chamber and the cylinder and is operative to selectively mix pressure gas from the accumulation chamber with fuel under pressure and to discharge the resultant fuel/gas mixture into the cylinder, and a fuel injector adapted to communicate with a source of fuel and operative to supply fuel under pressure to the discharge conduit at a pressure sufficient to open the valve in the discharge conduit and to mix pressure gas from the accumulation chamber with the fuel under pressure and discharge the resultant fuel/gas mixture into the cylinder.

34 Claims, 1 Drawing Sheet

FUEL SUPPLY SYSTEM FOR INTERNAL COMBUSTION ENGINE

BACKGROUND OF THE INVENTION

The invention relates generally to fuel supply systems for internal combustion engines. More particularly, the invention relates to fuel supply systems which include a fuel injector and, still more particularly, to fuel injection systems for spark ignited, two-stroke internal combustion engines.

The invention also relates to arrangements for injecting a fuel/gas mixture into a spark ignited internal combustion engine. In addition, the invention also relates to arrangements for creating a source of compressed gas which can be mixed with fuel and injected into a spark ignited internal combustion engine.

Attention is directed to the following U.S. Pat. Nos.:

| U.S. Pat. No. | Issue Date |
|---|---|
| 1,674,014 | June 19, 1928 |
| 2,111,560 | March 22, 1938 |
| 2,192,630 | March 5, 1940 |
| 2,329,363 | September 14, 1943 |
| 2,707,051 | April 26, 1955 |
| 2,819,728 | January 14, 1958 |
| 3,106,226 | October 8, 1963 |
| 3,116,752 | January 7, 1964 |
| 3,682,146 | August 8, 1972 |
| 3,785,355 | January 15, 1974 |
| 3,919,986 | November 18, 1975 |
| 4,103,648 | August 1,1978 |
| 4,191,135 | March 4,1980 |
| 4,210,105 | July 1, 1980 |
| 4,223,645 | September 23, 1980 |
| 4,232,641 | November 11, 1980 |
| 4,406,260 | September 27, 1983 |
| 4,413,652 | November 8, 1983 |

SUMMARY OF THE INVENTION

The invention provides an internal combustion engine comprising a cylinder, a piston reciprocal in the cylinder, means defining an accumulation chamber, supply conduit and valve means communicating between the cylinder and the accumulation chamber for supplying pressure gas from the cylinder to the accumulation chamber in response to piston reciprocation to thereby accumulate pressure gas in the accumulation chamber, discharge conduit and valve means communicating between the accumulation chamber and the cylinder and operative to selectively mix pressure gas from the accumulation chamber with fuel under pressure and to discharge the resultant fuel/gas mixture into the cylinder, and means adapted to communicate with a source of fuel and operative to supply fuel under pressure to the discharge conduit and valve means at a pressure sufficient to effect operation of the discharge conduit and valve means to mix pressure gas from the accumulation chamber with the fuel under pressure and to discharge the resultant fuel/gas mixture into the cylinder.

The invention also provides an internal combustion engine comprising a cylinder, a piston reciprocal in the cylinder, means defining an accumulation chamber, a supply conduit communicating between the accumulation chamber and the cylinder and including a check valve permitting flow to the accumulation chamber and preventing flow from the accumulation chamber, a valve seat between the check valve and the cylinder, a supply valve member movable relative to the valve seat and including a valve surface, and a spring normally biasing the supply conduit valve member to locate the valve surface away from the valve seat in the absence of a sufficient pressure in the cylinder, whereby to enable gas flow from the cylinder past the supply conduit valve member, past the check valve, and into the accumulation chamber, a discharge conduit communicating between the accumulation chamber and the cylinder and including therein a valve seat and a discharge valve member movable relative to the valve seat in the discharge conduit and including a valve surface engageable with the valve seat in the discharge conduit, means biasing the discharge valve member to a position engaging the valve surface thereon with the valve seat in the discharge conduit, a fuel injector communicating with the discharge conduit, and a fuel pump connected to the fuel injector and operable to supply fuel under pressure to the fuel injector.

The invention also provides a fuel supply system comprising an engine cylinder, a conduit communicating with the cylinder and adapted for communication with a source of pressure gas, which conduit includes a valve seat, a valve member movable relative to the valve seat and including a valve surface engagable with the valve seat, means biasing the valve member to a position engaging the valve surface with the valve seat, and means adapted to communicate with a source of fuel under pressure and including a fuel injector communicating with the conduit upstream of the valve seat for selectively discharging fuel under pressure into the conduit and for causing displacement of the valve surface away from the valve seat, whereby to permit inflow into said cylinder of fuel mixed with pressure gas.

The invention also provides an internal combustion engine comprising a cylinder, a piston reciprocal in the cylinder, means defining an accumulation chamber, and supply conduit and valve means communicating between the cylinder and the accumulation chamber for supplying gas from the cylinder to the accumulation chamber in response to piston reciprocation to accumulate pressure gas in the accumulation chamber, which supply valve and conduit means comprise a conduit communicating with the cylinder and with the accumulation chamber and including a valve seat, and a valve member having a valve surface movable relative to the valve seat.

A feature of the invention is to inject small amounts of compressed air simultaneously with the fuel so that air flow is regulated to coincide with fuel flow.

Other features and advantages of the invention will become apparent to those skilled in the art upon review of the following detailed description, claims, and drawings.

DRAWINGS

Figure 1:
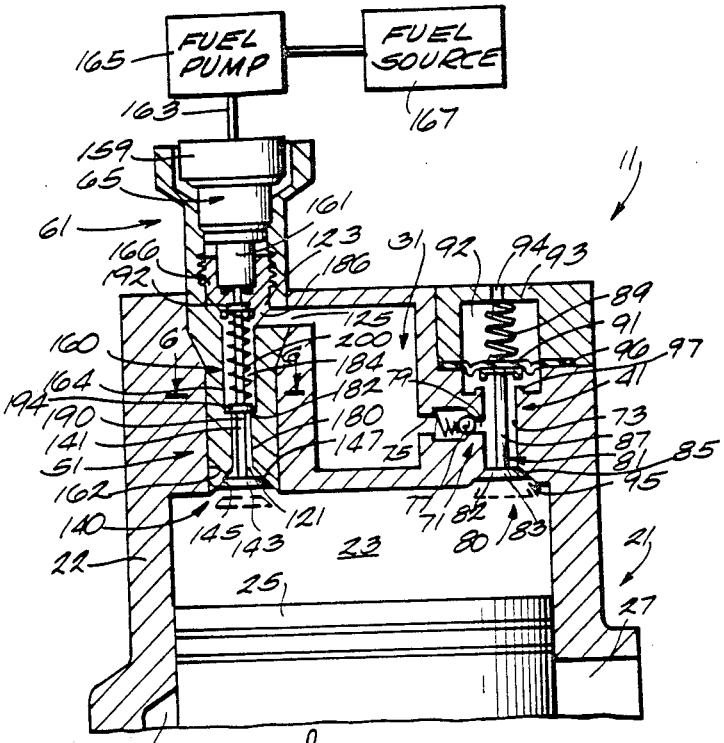
FIG. 1 is a fragmentary and diagramatic view of an internal combustion engine including a fuel supply system incorporating various of the features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 is a fuel supply system 11 for an internal combustion engine 21, preferably a two-stroke engine, which engine 21 includes an engine block or head 22 defining a cylinder 23, and a piston 25 moveable in the cylinder 23 relative to a top dead center position so as to vary the pressure in the cylinder 23 in a manner well known in the art.

The cylinder 23 also includes an exhaust port 27 and an inlet or transfer port 29 through which air is supplied to the cylinder 23, preferably from a crankcase (not shown) in the usual fashion.

The fuel supply system 11 includes means defining an accumulation chamber or plenum 31 for gas which is retained under pressure, which is supplied from the cylinder 23, and which comprises a steady, regulated source of compressed gas (mostly air). Because it is contemplated that the cylinder 23 will be normally supplied with air through the inlet port 29, the gas which is supplied to the accumulation chamber 31 is pressurized and, in large part, is air.

The accumulation chamber 31 can take various forms and preferably is formed, at least in part, in the engine block or head 22 which also defines the cylinder 23.

The fuel supply system 11 also includes supply conduit and valve means 41 communicating with the accumulation chamber 31 and with the cylinder 23 for supplying gas to the accumulation chamber 31 in response to piston reciprocation. In addition, the fuel supply system 11 also includes discharge conduit and valve means 51 communicating between the accumulation chamber 31 and the cylinder 23, for discharging to the cylinder 23 a fuel/gas mixture as will be explained.

Still further in addition, the fuel supply system 11 includes means 61 for spraying or supplying fuel under pressure to the discharge conduit and valve means 51 for operation thereof to mix pressure gas from the accumulation chamber 31 with the fuel under pressure and to discharge the resultant fuel/gas mixture into the cylinder 23.

More specifically, various supply conduit and valve means can be employed. In the construction disclosed in FIG. 1, such means 41 comprises a supply conduit 71 which extends between the head end of the cylinder 23 and the accumulation chamber 31 and which includes a first branch conduit or segment 73 having a first end communicating with the cylinder 23 and an opposite end, together with a second branch conduit or segment 75 which includes a first end communicating with the first branch conduit 73 between the ends thereof, and a second end communicating with the accumulation chamber 31. Included in the second branch conduit 75 is a check valve 77 permitting flow to the accumulation chamber 31 and preventing flow from the accumulation chamber 31. Any suitable check valve construction can be employed.

The supply conduit and valve means 41 also comprises a pressure actuated supply valve 80 including a valve member 81 which is movable between open and closed positions and which includes a valve head 82 having a valve surface 83 which, in the construction disclosed in FIG. 1, is conical and which is movable, in response to valve member movement, relative to a valve seat 85 which, in the construction shown in FIG. 1, is conical and which is formed in the first branch conduit 73 adjacent to the cylinder 23.

The supply conduit and valve means 41 also includes means normally biasing the valve surface 83 away from the valve seat 85 in the absence of gas in the cylinder 23 above a predetermined pressure. While various other arrangements can be employed, in the disclosed construction, the valve member 81 includes a stem 87 which extends through the opposite end of the first branch conduit 73 and which is engaged by a spring 89 bearing, at one end, against an outer head 91 on the stem 87 and, at the other end, against an engine block or head wall surface 93 so as to bias the valve member 81 downwardly, as seen in FIG. 1, and away from the valve seat 85.

Means are also provided for directing the gas flowing into the first branch conduit 73 from the cylinder 23 into the second branch conduit 75 and into the accumulation chamber 31, for closing the supply valve 80 when the pressure in the cylinder 23 accumulation chamber 31 reaches a predetermined value, and thereby regulating the pressure in the accumulation chamber 31, and for limiting outward travel of the valve head 82 away from the valve seat 85.

While other constructions can be employed to obtain these three functions, in the construction disclosed in FIG. 1, the outer head 91 is located in a chamber 92 which is provided in the engine block or head 22 and which is vented by a passage 94 to the atmosphere. Connected between the outer head 91 and the walls of the chamber 92 is a diaphram 96 which prevents escape through the vent passage 94 of the gas entering the first branch conduit 73 from the cylinder 23, which limits movement of the valve head 82 away from the valve seat 85 so as to provide an opening 95 which allows relatively unrestricted flow, and which also functions to close the supply valve 80 in response to pressure in the cylinder 23 and thereby to regulate the pressure in the accumulation chamber 31 to prevent over pressurization of the gas therein.

In this regard, when the supply valve 80 is in the fully open position, the valve head 82 is spaced from the valve surface 85 at a distance sufficiently large so that flow into the first branch conduit 73 from the cylinder 23 is unobstructed and so that cylinder pressure acts on the diaphram 96. Increasing pressure in the cylinder 23 and in the first branch conduit 73 acts to upwardly displace the diaphram 96 and the connected outer head 91 against the action of the spring 89. Such upward movement of the outer head 91 advances the valve surface 83 toward the valve seat 85 and, when a preselected pressure is present in the first branch conduit 73, causes closure of the supply valve 80.

Limitation of the movement of the valve member 81 away from the valve seats 85 can also be obtained by engagement of the outer head 91 with a bottom wall or surface 97 of the chamber 92.

If desired, the diaphram 96 can be constructed to also provide the function of the spring 89, and the spring 89 can then be omitted.

Thus, the supply valve 80 is normally biased open by the spring 89, but is displaced to the closed position by the diaphram 94 when the pressure in the cylinder 23 reaches a given level sufficient to overcome the action of the biasing spring 89. The gas pressure in the accumulation chamber 31 corresponds to the pressure in the first branch conduit 73 and approximately to the pressure in the cylinder 23 just prior to closure of the supply valve 80.

In operation of the construction shown in FIG. 1, movement of the piston 25 toward top dead center position compresses the gas in the cylinder 23 (primarily air introduced through the inlet port 29). Such compressed gas flows through the first and second branch conduits 73 and 75, past the check valve 77, and into the accumulation chamber 31 when the valve surface 83 is spaced from the valve seat 85 by action of the spring 89. As the piston 25 moves upwardly, a point is reached where the cylinder pressure acting against the diaphram 96 is high enough to close the pressure actuated supply valve 80 against the action of the spring 89. Such valve closure is designed to occur before commencement of combustion in the cylinder 23. After closure of the supply valve 80, the increasing pressure in the cylinder 23 keeps the supply valve 80 closed, combustion process proceeds normally, and the piston 25 then begins its downstroke.

If the size of the accumulation chamber 31 is of such large volume as to dilute or reduce the pressure in the first branch conduit 73 below the pressure in the cylinder 23 prior to closure of the supply valve 80, it is desirable to provide the second branch conduit 75 with a flow restriction or orifice 79 which can be located, as shown in FIG. 1, between the check valve 77 and the first branch conduit 73. If the accumulation chamber is sufficiently small, the orifice or restriction 79 can be omitted.

Figure 2:
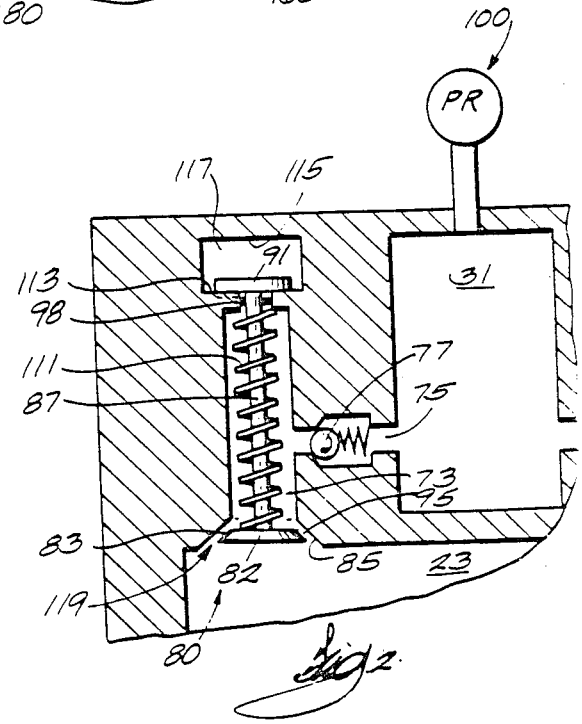
FIG. 2 is a fragmentary and diagramatic view of a modification of one of the features of the invention.

Another and alternative construction is shown in FIG. 2, wherein the same reference numerals have been employed to represent the same components. The FIG. 2 construction includes means for opening the supply valve 80 in the form of a spring 111 located around the stem 87 in the first branch conduit 73 and extending between the valve head 82 and a wall or stop or shoulder 113 in the branch conduit 73 spaced inwardly of the closed outer end 115 of the branch conduit 73.

In addition, the engine block or head 22 and the valve member 81 include means limiting valve member movement away from the valve seat 85. While other constructions can be employed, in the construction shown in FIG. 2, such means comprises the wall forming the shoulder 113 and the upper head or enlargement 91 on the valve stem 87 which upper head 91 is located in a closed chamber 117 which is formed by the outer end of the first branch conduit 73 and which prevents escape of gas entering the first branch conduit 73 from the cylinder 23, i.e., insures gas flow to the accumulation chamber 31. In the construction shown in FIG. 2, movement of the valve head 82 from the valve seat 85 is limited to a relatively short distance providing a restricted valve opening 119.

Means are provided for closing the supply valve 80 when the pressure in the cylinder 23 reaches a predetermined level. While other constructions could be employed, in the construction shown in FIG. 2, such means includes the restricted valve opening 119 which produces a pressure loss in the gas flowing from the cylinder 23 to the first branch conduit 73. Such pressure loss increases with increasing pressure in the cylinder 23 as the piston 25 moves toward top dead center due to increasing flow through the restricted opening 119 (and then into the accumulation chamber 31). As a consequence of such increasing pressure loss, an increasing pressure differential is created across the valve head 82, which pressure differential acts in opposition to the spring 111. Further in this regard, the spring 111 is selected so that the valve member 81 closes when the pressure across the valve head 82 reaches a predetermined value, for example, 20 psig.

In operation of the construction shown in FIG. 2, movement of the piston 25 toward top dead center position compresses the gas in the cylinder 23 (primarily air introduced through the inlet port 29). When the valve surface 83 is spaced from the valve seat 85 by action of the spring 111, such compressed gas flows through the first and second branch conduits 73 and 75, past the check valve 77, and into the accumulation chamber 31. As the piston 25 moves upwardly, a point is reached where the cylinder pressure is high enough to effect closure of the pressure actuated supply valve 80 against the action of the spring 89 and as a result of the pressure differential across the valve head 82 due to flow through the restricted opening 119 (and then into the accumulation chamber). Such valve closure is designed to occur before commencement of combustion in the cylinder 23. After closure of the supply valve 80, the combustion process proceeds normally and the piston 25 begins its downstroke.

More particularly, as the pressure in the cylinder 23 increases, the pressure differential across the valve head 82 also increases due to increasing flow through the restricted opening 119 (and into the accumulation chamber), overpowers the spring 89, and seats the valve surface 83 against the valve seat 85, thereby discontinuing further flow from the cylinder 23 into the accumulation chamber 31, while at the same time, serving to isolate the accumulation chamber 31. Further increasing pressure in the cylinder 23 also serves to maintain the supply valve 80 in tightly closed condition after initial closure.

It is noted, with respect to the operation of FIG. 1, that partial closing of the supply valve 80 will eventually locate the valve head 82 in closely spaced relation from the valve seat 85, thereby creating a restriction to flow which will generate a pressure differential across the valve head in much the same manner in which a pressure differential is created across the valve head in the operation of FIG. 2. Such pressure differential created as the supply valve 80 closes in the construction shown in FIG. 1, will act to help to complete the closing movement of the supply valve 80. After closure of the supply valve 80, the pressure in the cylinder 23 will serve to keep the supply valve 80 tightly closed at least until opening of the exhaust port 27.

Other constructions can be employed to insure that the gas entering the first branch conduit 73 from the cylinder 23 flows to the accumulation chamber 31. For instance, a seal 98 can be employed between the stem 87 and the wall 113 to insure gas flow to the accumulation chamber 31. In addition, other means can be employed to prevent excess pressure in the accumulation chamber 31. Accordingly, in the construction shown in FIG. 2, the accumulation chamber 31 communicates with a pressure regulator 100 which regulates the pressure in the accumulation chamber 31 and vents excessive pressure to the atmosphere, or to the exhaust manifold (not shown), or to the intake manifold (not shown), or to any other point as desired. In this regard, successive engine cycles will elevate the pressure in the accumulation chamber until the pressure relief valve 100 opens. From this point on, the pressure in the accumulation chamber 31 is limited to the setting of the pressure relief valve 100, which setting can be, for example, 70 psig. As a consequence, during each engine cycle, the valve member closes at a cylinder pressure of approximately 90 psig (70 psig in the chamber 31 plus 20 psig to close the valve member) and opens at pressure of approximately 20 psig across the valve head 82.

Accordingly, and with respect the embodiment shown in both FIGS. 1 and 2, the supply conduit and valve means 41 serves to accumulate in the accumulation chamber 31 a body of gas (mostly air) at the predetermined pressure in response to piston reciprocation. In addition, the volume of the accumulation chamber 31, as compared to the volume of gas used at each fuel injection, is sufficiently large so that the gas pressure is approximately constant under operating conditions. In addition, after combustion, when the pressure within the cylinder 23 becomes sufficiently low, in the construction shown in FIG. 2, the combination of spring force and trapped pressure above the pressure actuated supply valve 80 re-opens the supply valve 80. The cycle then repeats for each engine revolution until the accumulation chamber 31 is fully charged with compressed gas from the cylinder 23. Since the supply valve 80 closes on each cycle before combustion occurs, the gas trapped in the accumulation chamber 31 is relatively clean. In addition, the amount of gas supplied to the accumulation chamber 31, during each cycle, is relatively small, but is at least as large as the gas discharged from the accumulation chamber 31 each cycle.

Referring again to FIG. 1, the discharge conduit and valve means 51 comprises a first branch conduit or segment 121 including a first end communicating with the cylinder 23 and a second or blind end 123, together with a second branch conduit or segment 125 including a first end communicating with the first branch conduit 121 and a second end communicating with the accumulation chamber 31. In addition, the discharge conduit and valve means 51 includes a pressure actuated discharge valve 140 comprising a valve member 141 which includes a valve head 143 having a valve surface 145 moveable relative to a valve seat 147 which, in the construction disclosed in FIG. 1, is conical and which is located in the first branch conduit 121 adjacent to the cylinder 23.

Various means operative to supply fuel under pressure to the discharge conduit and valve means 51 at a pressure sufficient to effect operation thereof to mix pressure gas from the accumulation chamber 31 with fuel under pressure and to discharge the resultant mixture into the cylinder can be employed. In the disclosed construction, such means comprises a fuel injector 159 which includes a nozzle 161 and which is preferably electrically operated to discharge, at a given time and for a given period, pressure fuel into the branch conduit 121. Any suitable construction for the fuel injector 159 construction can be employed. It is preferred that the fuel injector 159 be solenoid operated, as is known in the art, and that the fuel injector 159 communicate through a suitable fuel supply conduit 163 with the outlet of a fuel pump 165 which is adapted to be connected to a suitable fuel source 167 and which is capable of providing fuel under suitable pressure. Any suitable fuel pump construction can be employed.

Figure 3:
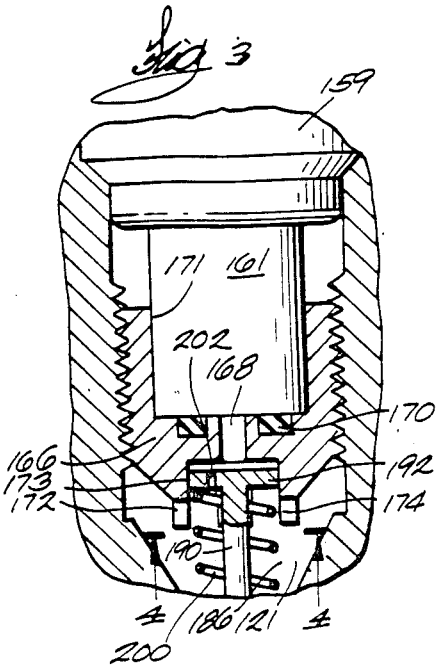
FIG. 3 is an enlarged view in section of a portion of the construction shown in FIG. 1.

More particularly, in the construction shown in FIG. 1, the first branch conduit 121 is provided in a housing or member 160 which is fixedly assembled in a suitable opening 162 in the engine block or head 22, and which includes centrally thereof an internal bore 164 providing the first branch conduit 121. In the middle portion of the bore 164, the housing 160 is counterbored and threaded to receive therein a bushing 166 which closes the upper end of the first branch conduit 121 and which includes (See FIG. 3) a through-bore or fuel passage 168 which is communicable with the first branch conduit 121. At its upper end, the bushing 166 includes a counterbore 171 which receives the nozzle 161 of the fuel injector 159 so that fuel flow from the fuel injector 159 is directed into the through-bore or fuel passage 168. A suitable seal 170 can be employed between the end of the nozzle 161 and the bottom wall of the upper counterbore 171 to prevent loss of fuel and/or pressure. At its lower end, the through-bore or fuel passage 168 includes a lower counterbore 173 which receives an outer head or piston still to be described. The outer or lower end of the counterbore 173 is defined by a relatively thin cylindrical wall 172 which includes a plurality of radially extending and angularly spaced notches or cut-outs 174 which extend upwardly from the lower end of the cylindrical wall 172 for a length less than the axial length of the counterbore 173.

Still more particularly, in the construction shown in FIG. 1, the valve seat 147 diverges outwardly toward the cylinder 23 and communicates, at its inner end, with an axially elongated conduit portion 180 which has a relatively small diameter and which terminates at a shoulder 182 forming one end of another axially elongated conduit portion 184 which has a somewhat larger diameter and which communicates, at its upper end, with a conical conduit portion 186 which flairs outwardly to a somewhat enlarged cylindrical portion which is provided by the already described threaded counterbore which receives the bushing 166. The conical portion 186 of the first branch conduit 121 communicates with the second branch conduit 125.

In the construction shown in FIG. 1, the valve member 141 also includes a stem 190 extending inwardly of the first branch conduit 121 and terminating at its upper end in a (before mentioned) outer head or piston 192 (See FIG. 3) which, when the valve head 143 engages the valve seat 147, is located in the counterbore 173 in adjacent blocking relation to the discharge outlet or nozzle 161 of the fuel injector 159 and above the notches or cut-outs 174 previously described.

Figure 6:
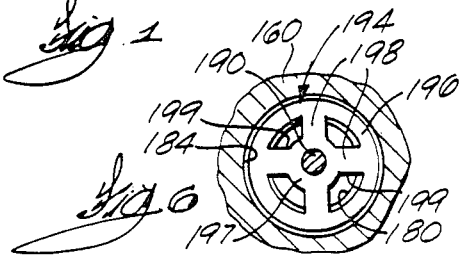
FIG. 6 is an enlarged view, partially in section, and with parts omitted, taken along 6—6 of FIG. 1.

Means are provided for biasing the valve member 141 to the closed position. While other constructions can be employed, in the disclosed construction, such means comprises a spring 200 which encircles the stem 190 and which, at its upper end, bears against the outer head or piston 192 and which, at its lower end, bears (See FIG. 6) against a wheel or spoke washer 194 which is seated on the shoulder 182 and which includes an outer annular portion 196 engaging the outer wall of the conduit portion 184 and an inner annular portion 197 which includes an aperture through which the valve stem 190 passes. The outer annular portion 196 is connected to the inner annular portion 197 by a plurality of spokes 198 which define a series of annularly spaced openings 199 affording fuel and air flow between the conduit portions 180 and 184.

It is noted that the spring 200 has sufficient strength to bias the valve surface 145 against the valve seat 147, notwithstanding the pressure in the first branch conduit 121 which is the same as the gas pressure in the accumulation chamber 31.

Figure 4:
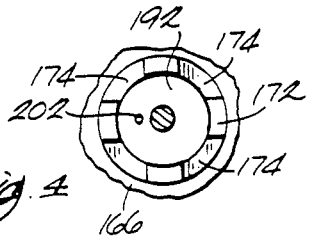
FIG. 4 is an end view taken along line 4—4 of FIG. 3.

The piston 192 includes (see FIG. 3 and 4) an orifice 202 which is sized so as to be small enough in order that the fuel flow from the injector 159 is sufficient to generate enough pressure across the piston 192 to overcome the spring 200 and displaces the valve member 141 downwardly and which is large enough to permit the spring 200 to rapidly reclose the valve surface 145 against the valve seat 147 after fuel flow from the fuel injector 159 has been terminated. If desired, the diameter of the piston 192 can be sufficiently smaller than the diameter of the counterbore 173 to permit the movements described immediately above.

Means are provided for opening the discharge valve 140 and for limiting the travel of the valve head 143 away from the valve seat 147. While other arrangements can be employed, in the disclosed construction, such means comprises the outer head or piston 192 and the notches or cut-outs 174. More particularly, when the fuel injector 159 is actuated to supply fuel under pressure, such pressure fuel acts against the piston 192 and initially downwardly displaces the valve member 141 against the action of the spring 200 until the cut-outs or notches 174 are uncovered. Such uncovering permits the fuel to flow radially outwardly without causing any further downward displacement of the valve member 141 so as, in effect, to balance the force of the pressure fuel against the force of the spring 200 and thereby limit the travel of the valve head 143 away from the valve seat 145.

In operation, the fuel injector 159 discharges or sprays a measured amount of fuel under pressure into the first branch conduit 121 for mixture with the compressed gas from the accumulation chamber 31. The pressure of the fuel discharged from the fuel injector 159 is greater than the gas pressure in the accumulation chamber 31 and, acting against the piston 192, is sufficient to overcome the bias of the spring 200 which, in the absence of the fuel pressure, maintains the valve surface 145 in sealing engagement with the valve seat 147.

The high velocity of the pressure gas and fuel discharged from the first branch conduit 121, and past the valve head 143 and into the cylinder 23, causes fine atomization of the fuel.

Figure 5:
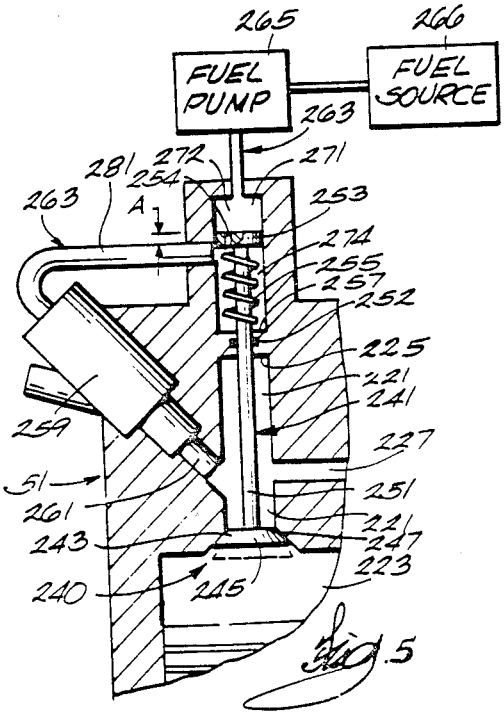
FIG. 5 is a fragmentary and diagramatic view of a modification of another of the features of the invention.

Shown in FIG. 5 is another embodiment of a discharge conduit and valve arrangement and, in this embodiment, the discharge conduit and valve means 51 comprises a first branch conduit or segment 221 including a first end communicating with a cylinder 223 and a second or blind end 225, together with a second branch conduit or segment 227 including a first end communicating with the first branch conduit 221 and a second end communicating with the accumulation chamber 31. In addition, the discharge conduit and valve comprises a valve member 241 which includes a valve head 243 having a valve surface 245 moveable relative to a valve seat 247 which, in the construction shown in FIG. 5, is conical and which is located in the first branch conduit 221 adjacent to the cylinder 223.

The discharge conduit and valve means 51 also includes means for biasing the valve member 241 to engage the valve surface 245 with the valve seat 247 to prevent flow from the accumulation chamber 31 into the cylinder 223. While various other constructions can be employed, in the construction disclosed in FIG. 5, the valve member 241 includes a valve stem 251 extending from the valve head 243 and passing through the blind end 225 of the first branch conduit 221 in a pressure-tight relation thereto. In this regard, any suitable seal, such as the seal 252, can be provided. At its outer end, the stem 251 includes an outer head or piston 253 which is engaged with one end of a spring 255 which surrounds the stem 251, and which, at its other or inner end, engages a wall surface 257 formed in the engine block or head 22 adjacent the blind end 225 of the first branch conduit 221.

Thus the valve surface 245 is normally retained in closed relation to the valve seat 247 and discharge of the pressure gas from the accumulation chamber 31 into the engine cylinder 223 is normally prevented.

Various means operative to supply fuel under pressure to the discharge conduit and valve means 51 at a pressure sufficient to effect operation thereof to mix pressure gas from the accumulation chamber 31 with fuel under pressure and to discharge the resultant mixture into the cylinder can be employed. In the construction disclosed in FIG. 5, such means comprises a fuel injector 259 which includes a nozzle 261 and which is preferably electrically operated to discharge, at a given time and for a given period, pressure fuel into the branch conduit 221. Any suitable fuel injector construction can be employed. It is preferred that the fuel injector 261 be solenoid operated, as is known in the art, and that the fuel injector 261 communicate through a suitable fuel supply conduit 263 with the outlet of a fuel pump 265 which is adapted to be connected to a suitable fuel source 266 and which is capable of providing fuel under the desired pressure. Any suitable fuel pump construction can be employed.

Means are also provided for opening the discharge valve 240 and for limiting the travel of the valve surface 245 away from the valve seat 247. While various other constructions can be employed, in the construction disclosed in FIG. 5, such means includes the fuel supply conduit 263 and the outer head or piston 253. More particularly, while the fuel supply conduit 263 can take various forms, in the construction disclosed in FIG. 5, the fuel supply conduit 263 includes a first portion 271 which communicates with the outlet of the fuel pump 265, which is in alignment with the first branch conduit 221, which extends from the wall 257, which receives a portion of the stem 251 and the enlarged outer head or piston 253 on the stem 251, and which is dimensioned such that the outer head or piston 253 closely fits within the conduit portion 271 so as to be subject to the pressure of the pressurized fuel in the fuel conduit portion 271. The first fuel conduit portion 271 further includes an upper segment 272 above the piston 253 and a lower segment 274 below the piston 253. In addition, in the construction disclosed in FIG. 5, the fuel supply conduit 263 includes a second portion 281 extending from the first portion 271 and leading to the inlet of the fuel injector 259.

As in the embodiment shown in FIG. 1, the piston 253 is constructed to include an orifice 254 which is sized so as to be small enough in order that the fuel flow from the fuel pump 265 is sufficient to generate enough pressure across the piston 253 to overcome the spring 255 and displace downwardly the valve member 241 to the open position, and which is sized to be large enough to permit the spring 255 to rapidly reclose the valve surface 245 against the valve seat 247 after fuel flow from the fuel injector 259 has been terminated. If desired, the diameter of the piston 253 can be sufficiently smaller than the diameter of the fuel conduit portion 271 to permit the movements described immediately above.

Still more particularly, the means for opening the discharge valve 240 and for limiting travel of the valve head 243 away from the valve seat 247 also includes location of the juncture of the second fuel supply conduit portion 271 with the first fuel supply conduit portion 281 at a location spaced a small distance "A" below the upper surface of the outer head or piston 253 of the valve member 241.

This piston 253 preferably has a thickness less than the height or diameter of the conduit portion 281 at the point of juncture with the conduit portion 271 so that the fuel has ample opportunity to flow laterally into the conduit portion 281 before the bottom of the piston 253 fully circumferentially engages the conduit portion 271 and so that blockage between the conduit portion 281 and the conduit segment 274 is prevented before such lateral fuel flow.

Thus, in operation, the fuel pump 265 serves to pressurize the fuel supply conduit 263 up to the fuel injector 259. However, when the fuel injector 259 is closed, and with pressure fuel located in the supply conduit portion 271 both above and below the piston 253, the spring 255 is effective to maintain the discharge valve 240 closed and to maintain the valve head 243 against the valve seat 247. However, when the fuel injector 259 is actuated, the pressure of the fuel in the second fuel supply conduit portion 281 and in the conduit segment 274 below the piston 253 falls, with the result that the pressure differential between the fuel above and below the piston 253 causes downward movement of piston 253 until it uncovers the second fuel supply conduit portion 281 and permits outflow of fuel into the second fuel supply conduit portion 281, thereby re-pressurizing the second fuel supply conduit portion 281 as well as that lower segment 274 of the first fuel supply conduit portion 271 beneath the piston 253. Such uncovering permits fuel flow and re-pressurization as indicated above and with the result that further outward travel of the valve member 241 is discontinued by action of the spring 255.

In the embodiment disclosed in FIG. 5, the pressure of the fuel discharged from the fuel injector 259 into the first branch conduit 221 is greater than the pressure in the accumulation chamber 31 and the pressure of the fuel supplied to the fuel supply conduit 263 and acting upon the upper face of the piston 253 is sufficiently large enough to overcome the spring 255 and thereby to displace the valve member 241 to the open position shown in dotted outline in FIG. 5. It is noted that, in the construction shown in FIG. 5, when the fuel injector 259 is discharging, the pressure of the fuel supplied by the fuel pump 265 is higher than the pressure of the fuel discharged by the fuel injector 259, and that the action of the piston 253 in the fuel supply conduit portion 271 corresponds to the action of the piston 192 in the counterbore 173 (shown in FIG. 3) except that, in FIG. 5, the piston 253 is located upstream of the fuel injector 259 and, in the construction shown in FIG. 1, the piston 192 is located downstream of the fuel injector 159.

While the disclosed construction involves one cylinder 23 and one accumulation chamber 31, a single accumulation chamber can be employed to supply compressed gas for fuel injection with respect to more than one cylinder. In addition, a single accumulation chamber can be supplied gas from more than one cylinder.

Various of the features of the invention are set forth in the following claims:

We claim:

1. An internal combustion engine comprising a cylinder, a piston reciprocal in said cylinder, means defining an accumulation chamber, supply conduit and valve means communicating between said cylinder and said accumulation chamber for supplying pressure gas from said cylinder to said accumulation chamber in response to piston reciprocation to thereby accumulate pressure gas in said accumulation chamber, discharge conduit and valve means communicating between said accumulation chamber and said cylinder and operative to selectively mix pressure gas from said accumulation chamber with fuel under pressure and to discharge the resultant fuel/gas mixture into said cylinder, and means adapted to communicate with a source of fuel and operative to supply fuel under pressure to said discharge conduit and valve means at a pressure sufficient to effect operation of said discharge and conduit valve means to mix pressure gas from said accumulation chamber with the fuel under pressure and to discharge the resultant fuel/gas mixture into said cylinder.

2. An internal combustion engine in accordance with claim 1 wherein said supply conduit and valve means includes a supply conduit communicating between said accumulation chamber and said cylinder and including a check valve permitting flow to said accumulation chamber, said supply conduit also including, between said check valve and said cylinder, a valve seat, and wherein said supply conduit and valve means also includes a valve member movable relative to said valve seat and including a valve surface and means normally biasing said valve member to locate said valve surface away from said valve seat in the absence of sufficient pressure in said cylinder, whereby to enable gas flow from said cylinder past said valve member, past said check valve, and into said accumulation chamber.

3. An internal combustion engine in accordance with claim 2 wherein said supply conduit includes a first branch supply conduit having a first end communicating with said cylinder and an opposite second end, wherein said supply conduit also includes a second branch supply conduit having a first end communicating with said first branch supply conduit intermediate said first and second ends thereof, said second branch supply conduit having a second end communicating with said accumulation chamber and including therein said check valve, and wherein said valve seat is located adjacent said first end of said first branch supply conduit.

4. An internal combustion engine in accordance with claim 3 wherein said means normally biasing said valve member comprises a spring operatively engaged with said valve member to bias said valve member so as to releasably sealingly engage said valve surface with said valve seat.

5. An internal combustion engine in accordance with claim 1 wherein said discharge conduit and valve means includes a discharge conduit having therein a valve seat, and a valve member movable relative to said valve seat and including a valve surface engagable with said valve seat, wherein said discharge valve and conduit means also includes means biasing said valve member to a position engaging said valve surface with said valve seat, and wherein said fuel injector communicates with said discharge conduit upstream of said valve seat.

6. An internal combustion engine in accordance with claim 5 wherein said discharge conduit includes a first branch discharge conduit having a first end communication with said cylinder and a blind end, said discharge conduit also including a second branch discharge conduit communicating with said first branch discharge conduit intermediate said ends thereof and with said accumulation chamber.

7. An internal combustion engine in accordance with claim 6 wherein said valve member includes a portion extending in said first branch discharge conduit and through said blind end in sealing relation thereto and including an outer end, and a head on said outer end, and wherein said biasing means engages said head.

8. An internal combustion engine in accordance with claim 7 and further including a fuel pump including an outlet and operable to supply fuel under pressure, and a fuel supply conduit extending between said fuel pump outlet and said fuel injector, and wherein said valve member extends into said fuel supply conduit and is subject to the fuel pressure therein.

9. An internal combustion engine comprising a cylinder, a piston reciprocal in said cylinder, means defining an accumulation chamber, a supply conduit communicating between said accumulation chamber and said cylinder and including a check valve permitting flow to said accumulation chamber and preventing flow from said accumulation chamber, a valve seat between said check valve and said cylinder, a supply valve member movable relative to said valve seat and including a valve surface, and a spring normally biasing said supply conduit valve member to locate said valve surface away from said valve seat in the absence of a sufficient pressure in said cylinder, whereby to enable gas flow from said cylinder past said supply conduit valve member, past said check valve, and into said accumulation chamber, a discharge conduit communicating between said accumulation chamber and said cylinder and including therein a valve seat and a discharge valve member movable relative to said valve seat in said discharge conduit and including a valve surface engagable with said valve seat in said discharge conduit, means biasing said discharge valve member to a position engaging said valve surface thereon with said valve seat in the discharge conduit, a fuel injector communicating with said discharge conduit, and a fuel pump connected to said fuel injector and operable to supply fuel under pressure to said fuel injector.

10. A fuel supply system comprising an engine cylinder, a conduit communicating with said cylinder and adapted for communication with a source of pressure gas, said conduit including a valve seat, a valve member movable relative to said valve seat and including a valve surface engagable with said valve seat, means biasing said valve member to a position engaging said valve surface with said valve seat, and means adapted to communicate with a source of fuel and including a fuel injector communicating with said conduit upstream of said valve seat for selectively discharging fuel under pressure into said conduit and for causing displacement of said valve surface away from said valve seat, whereby to permit inflow into said cylinder of fuel mixed with pressure gas.

11. An internal combustion engine in accordance with claim 10 wherein said conduit includes a first branch conduit having a first end communication with said cylinder and a second end, said conduit also including a second branch conduit communicating with said first branch conduit intermediate said ends thereof and adapted for communication with the pressure source.

12. A fuel system in accordance with claim 11 wherein said valve member includes a portion extending in said first branch conduit and through said second end in sealing relation thereto and including an outer end, and a head on said outer end of said valve member, and wherein said biasing means engages said head.

13. A fuel system in accordance with claim 10 and further including a fuel pump operable to supply fuel under pressure and including an outlet, a second conduit extending between said fuel pump outlet and said fuel injector, and wherein said valve member extends into said second conduit and is subject to the fuel pressure therein.

14. A fuel system in accordance with claim 10 wherein said conduit includes a first end adjacent said cylinder and a second end spaced from said first end, wherein said valve seat is adjacent said first end, and wherein said fuel injector includes an outlet communicating with said second end of said conduit.

15. A fuel system in accordance with claim 14 wherein said second end of said conduit includes a counterbore, and wherein said valve member includes a valve head having thereon said valve surface, a stem located in said conduit and extending from said valve head, and a piston connected to said valve stem and located, when said valve surface is engaged with said valve seat, in said counterbore.

16. A fuel supply system in accordance with claim 15 wherein said conduit includes, intermediate said ends, a shoulder fixed with respect to said conduit and having therein an aperture which encircles said stem, and wherein said biasing means comprises a spring having one end engaging said shoulder, and a second end engaging said piston to thereby bias said valve surface into engagement with said valve seat.

17. A fuel supply system in accordance with claim 16 wherein spring encircles said stem.

18. A fuel supply system in accordance with claim 15 wherein said counterbore has a diameter, and wherein said piston has a diameter less than said counterbore diameter to afford fuel flow therebetween.

19. A fuel supply system in accordance with claim 15 wherein said piston includes therein a aperture.

20. A fuel system in accordance with claim 15 wherein said counterbore is defined by a cylindrical wall having an outer end, said cylindrical wall also including therein a series radially extending through notches.

21. A fuel supply system in accordance with claim 10 and further including means limiting movement of said valve member away from said valve seat.

22. An internal combustion engine comprising a cylinder, a piston reciprocal in said cylinder, means defining an accumulation chamber, supply conduit and valve means communicating between said cylinder and said accumulation chamber for supplying gas from said cylinder to said accumulation chamber in response to piston reciprocation to accumulate pressure gas in said accumulation chamber, said supply valve and conduit means comprising a conduit communicating with said cylinder and with said accumulation chamber and including a valve seat, a valve member having a valve surface movable relative to said valve seat, and a check valve located between said valve seat and said accumulation chamber, permitting flow to said accumulation chamber, and preventing flow from said accumulation chamber.

23. An internal combustion engine in accordance with claim 22 wherein said conduit includes a first branch conduit having a first end communicating with said cylinder and an opposite second end, wherein said conduit also includes a second branch conduit having a first end communicating with said first branch conduit intermediate said first and second ends thereof, and a second end communicating with said accumulation chamber, wherein said check valve is located between said first and second ends of said second branch conduit, and wherein said valve seat is located in said first branch conduit adjacent said cylinder.

24. An internal combustion engine in accordance with claim 22 and further including means normally biasing said valve member away from said valve seat in the absence of sufficient pressure in said cylinder, whereby to enable gas flow from said cylinder past said valve member, past said check valve, and into said accumulation chamber.

25. An internal combustion engine in accordance with claim 24 wherein said biasing means comprises a spring operatively engaged with said valve member and biasing said valve member from said valve seat.

26. An internal combustion engine comprising a cylinder, a piston reciprocal in said cylinder, means defining an accumulation chamber, and supply conduit and valve means communicating between said cylinder and said accumulation chamber for supplying gas from said cylinder to said accumulation chamber in response to piston reciprocation to accumulate pressure gas in said accumulation chamber, said supply valve and conduit means comprising a conduit communicating with said accumulation chamber and including a first conduit segment having an end communicating with said cylinder, a shoulder spaced from said end, and a valve seat, and a valve member movable relative to said valve seat and including a valve head engagable with said valve seat, a spring located in said conduit segment and having a first end engaged with said valve head and having a second end engaged with said shoulder whereby to bias said valve surface away from said valve seat.

27. An internal combustion engine in accordance with claim 26 wherein said valve member includes a stem extending from said valve head and wherein said spring surrounds said stem.

28. An internal combustion engine in accordance with claim 27 and further including an engine block defining said cylinder and said conduit segment, and means on said engine block and said valve member limiting valve member movement away from said valve seat.

29. An internal combustion engine comprising a cylinder, a piston reciprocal in said cylinder, means defining an accumulation chamber, and supply conduit and valve means communicating between said cylinder and said accumulation chamber for supplying gas from said cylinder to said accumulation chamber in response to piston reciprocation to accumulate pressure gas in said accumulation chamber, and supply valve and conduit means comprising a conduit communicating with said cylinder and with said accumulation chamber and including a valve seat, and a valve member movable relative to said valve seat, and normally retained in spaced relation to said valve seat in the absence of a predetermined pressure in said cylinder.

30. An internal combustion engine in accordance with claim 29 and further including means for regulating the pressure in said accumulation chamber.

31. An internal combustion engine in accordance with claim 30 wherein said valve member includes a valve stem extending in said conduit, wherein said pressure regulating means comprises a pressure chamber aligned with and communicating with said conduit, and a diaphram extending across said chamber and connected to said stem for common movement with said valve member.

32. An internal combustion engine in accordance with claim 31 wherein said pressure regulating means further comprises means engaging said diaphram and biasing said valve member toward a position with said valve member spaced from said valve seat.

33. An internal combustion engine in accordance with claim 29 and further including means limiting valve movement away from said valve seat.

34. An internal combustion engine in accordance with claim 29 wherein said valve seat and said valve member define, when said valve member is spaced from said valve seat, a valve opening which provides a restriction to flow between said cylinder and said conduit.

* * * * *